US010789861B1

(12) United States Patent
Boddie

(10) Patent No.: US 10,789,861 B1
(45) Date of Patent: Sep. 29, 2020

(54) IDENTIFICATION TAG WITH NOVEL CASE CONSTRUCTION

(71) Applicant: Joseph Boddie, Jackson, MS (US)

(72) Inventor: Joseph Boddie, Jackson, MS (US)

( * ) Notice: Subject to any disclaimer, the term of this patent is extended or adjusted under 35 U.S.C. 154(b) by 0 days.

(21) Appl. No.: 16/544,913

(22) Filed: Aug. 20, 2019

(51) Int. Cl.
*G09F 3/20* (2006.01)
*A44C 15/00* (2006.01)
*G09F 3/14* (2006.01)

(52) U.S. Cl.
CPC ..... *G09F 3/20* (2013.01); *A44C 15/004* (2013.01); *G09F 3/14* (2013.01); *G09F 3/207* (2013.01)

(58) Field of Classification Search
CPC ..... G09F 3/207; A44C 3/001; A44C 13/00; A44C 25/00; A44C 25/001; A44C 25/002; A44C 25/004; A44C 25/007
USPC ..... 63/1.11, 1.15, 18, 19, 21, 23
See application file for complete search history.

(56) References Cited

U.S. PATENT DOCUMENTS 4,353,124 A * 10/1982 Weinzettel ..... G04B 37/00 368/258
4,592,219 A * 6/1986 Richter ..... A44B 15/00 70/456 R
5,359,798 A * 11/1994 Pelosi ..... A44C 25/00 40/661.06
8,881,403 B2 * 11/2014 Gobbato ..... A44C 25/004 29/11

* cited by examiner

*Primary Examiner* — Kristina N Junge
(74) *Attorney, Agent, or Firm* — Fraline J. Allgaier

(57) ABSTRACT

An identification locket having a novel construction and tracks extending the entire periphery of the exterior housing and being entirely embedded therein. The tracks form c-shaped channels in the side walls and being adapted to house at one guide ball and the guide being further characterized by a guide rope and bail being placed thereon. The guide ball is freely rotatable and is configured to rotate within the tracks. The side walls and the tracks have at least on mating projecting edge. The guide ball is configured to rotate within the track with backward or forward movements and the track is configured to rotate a plurality of the guide balls relative to each and wherein the guide rope freely rotates on the outside of the tracks.

4 Claims, 15 Drawing Sheets

IDENTIFICATION TAG WITH NOVEL CASE CONSTRUCTION

BACKGROUND OF THE INVENTION

The present invention relates generally to identification tags and similar devices that are attachable to a chain and being used for the identification of a person, pet, animal, or various types of objects. More particularly, the present invention relates to various embodiments of removable tags and similar devices that are adapted to be worn as jewelry for attachment to chains, key chains, or necklaces that are traditionally worn for decorative or identification purposes. The removable tags enable the user to easily identify his or her pet, jewelry, luggage, or devices from a group of similar animals or items.

The use of distinctive identifying tags, lockets, badges, and plates, that are used for decorative purposes or to identify the owner or an article is well know in the prior art. Identification tags, or the like, have historically been used to identify individuals, pets, animals, or items that are valuable to a user. The tags may be placed on a necklace of variable length or placed directly on the object that required identification or protection. They are often placed around the neck, in pockets, clothing, or inside the shoe of the user.

It has been recognized that further information beyond merely name and address can be very valuable and should be displayed on an identification tag. For example, medical information relating to allergies, blood type, diseases, medical conditions, and currently used medication is extremely valuable in the case of a medical emergency. Various types of identification tags integrating private information are well know in the prior art.

Recent patents issued to by Zimmerman, U.S. Pat. No. 3,178,842 and Destal U.S. Pat. No. 3,180,042 describe identification tags in the form of information lockets that contain information that is readily visible to the naked eye. The information displayed on the information lockets is reduced in size but the locket allows for the display of large amounts of medical information that are relevant for the owner. The Zimmerman U.S. Pat. No. 3,178,842 further shows a locket that is presented in the form or a fold-up case with a magnifying glass and transcript of the owner's medical information. The case is folded to form the locket. The Destal U.S. Pat. No. 3,180,042 presents an identification locket with relevant medical information. However, the user is required to find a magnifying glass in order to read the relevant medical history contained in the locket.

Identification tags that have been used as keychain attachments are also present in the prior art. The Pierette French patent, international registration number 82 20753, has a key carrier with a ring for attachment of keys. The identification tag is adapted to provide a wealth of medical information that is likely to be of use in the event of an accident. The case of the identification tag can include photographs and a ring pendant, which allows the user to enter a name and address.

Various types of tags are available in the public domain to aid in the identification of users for specific health problems. These can include Medic Alert bracelets that identify the user along with any specific health concerns and provide specific instructions to medical personnel for required treatments. Many provide fall detection, push buttons for chest pain, 2-way-communication hubs to dispatch for help, GPS, and cellular services. These types of bracelets are often used for patients with diagnosed medical problems such as epilepsy, diabetes, allergies, and other substantial health conditions.

Members of the armed forces may wear identification tags that are used primarily for the identification of deceased or wounded soldiers. These identification tags might provide the soldiers information including the blood type, religious preferences, branch of service, Department of Defense identification number, and other important information that might be relevant when the soldier is on the battlefield. Military identification tags are manufactured from metals that are rust-resistant such as stainless steel aluminum, copper, bronze, brass, or galvanized steel. They are often manufactured in a manner that provides the military personnel with a double-sided metal plate with identical information being placed on both sides. The edges are strategically rolled and a hole is placed on the top end of the device with an 18-inch chain being placed therein.

Identification tags in the form of lockets or pendants are also well know in the prior art. Some lockets and pendants are attached to chains and feature interior containers as useable storage space for small items such as pictures, other jewelry, pocket watches, wristwatches, etc. Most feature front covers or doors that open or close with actuated spring action. Historically they have be produced and sold as gift items for special occasions such as christenings, weddings, funerals, Valentine's Day, etc. They are also produced in various shapes such as ovals, hearts and circles.

Many lockets are fashioned in a plurality of suspension formats including lockets worn around the neck and suspended by chains, ribbons, or other ornamental objects. Some can be attached to spinning bails that allow the locket to continuously rotate around on a chain. Keepsake lockets are those constructed with a frontal glass pane that allows the contents to be clearly visible. These lockets were historically very popular and used to display hairpieces, perfume, buttons, etc. Perfume lockets are designed for housing photos, names, and other identification information of a user.

Identification tags have recently been used in youth fashion. They are often sold in the form of lockets and are inscribed with personal information, religious beliefs, personal tastes, favorite quotes, websites, or the locket may bear the name or logo of a band or performer. Custom dog tags were also fashionable in the 1990s among rappers and R&B artists. Personalized dog tags were publicly offered and sold with personalized logs, favorite quotes, and company logos.

Most luggage or travel bags do not carry noticeable trademarks or logos. Therefore, distinctive identification tags are commonly used on luggage items to provide for quick and ready identification of a user's luggage. In most cases, a particular piece of luggage is readily identified by inspecting a personalized card that is inserted in a plastic luggage tag or by removing covered flaps from plastic tags that have been used to ensure the privacy of a user. Some luggage identification tags have double-sided walled members that allow the user to insert a plurality of identification cards. The walled members are personalized and the user inspects the cards before removing the luggage or travel bags from an airport carousel or travel dock.

None of the aforementioned inventions and patents, taken either singly or in combination, describes the invention as claimed herein. To this end, the identification tags of the present invention will make the identification process convenient, easier, and more enjoyable. The tags are attachable to a chain and can be used for ready identification in a plurality of settings including attachment as a tag to a person, pet, animals, or objects. It can be worn as jewelry in the form of locket for attachment to chains or necklaces or as a personalized keychain. The removable tag further enables the user to easily identify his or her pet, jewelry, luggage, or devices from a group of similar animals or items.

The improved identification tag of the present invention features an exterior housing with peripheral tracks extending the entire periphery of the side walls. The tracks form c-shaped channels on the side walls of the housing and are entirely embedded within the walls. At least one guide ball is directed by a guide rope to rotate the tag within the tracks using circular, backward or forward movements. The projecting edges of the side wall and track steady the guide ball within the track. This is particularly useful if the tag is worn as a locket, suspended from the neck area of a pet, or used as a keychain.

Additional features of the identification tag include an exterior housing with identification elements that can be placed thereon for further identification of a person, person, pet, keychain, or object. The identification elements can be constructed from various types of decorative materials, carbon fiber, or metals and can be placed around the entire perimeter of the identification tag in a personalized format.

There is quick and easy access to the tag and the tags can be oriented horizontally and vertically. This versatile positioning provides for identification of devices being arranged in any format with minimum effort. The position of the identification tag can be quickly re-adjusted from a vertical position to a horizontal position. It is another object of the invention to provide an identification tag of the above character, which is of such size that it may be conveniently carried in a pocket or purse, and yet facilitate a prompt return of the article to which it may be attached.

The improved identification tag of the present invention is low cost and easy to manufacture, advantageous for use on humans, animals, or on devices and configured to address the aforementioned concerns that are not present in the prior art.

BRIEF SUMMARY OF THE INVENTION

It is therefore an objective of the present invention to address the above concerns and to provide a new identification locket of novel housing construction for use as badges, tags, and similar devices that are attachable to a chain and being used for the identification of a person, pet, or object.

Another objective of the present invention is to provide various embodiments of removable tags that are adapted to be worn as lockets for attachment to chains or necklaces that are traditionally worn for decorative or identification purposes.

Another objective of the present invention is to provide an improved identification tag having an exterior housing with peripheral tracks extending the entire periphery of said side walls and being entirely embedded therein. Said tracks forming c-shaped channels on said side walls.

Another objective of the present invention is to provide an improved identification tag with tracks that are adapted to house at least one guide ball and being guide tracks for said guide ball. Said guide ball being further characterized by a guide rope for placement thereon and for further attachment to a standard bail of generally semi-circular shape with pivot points on two opposed sides. Said guide ball being freely rotatable and being configured to rotate within said tracks with circular, backward, or forward movements.

Another objective of the present invention is to provide an improved identification tag having a track and a mating side wall with at least one projecting edge being concave and having a substantially arched downward slope and extending upwardly at a 45 degree angle toward said corresponding side wall. The projecting edges retaining said guide ball within the opposite side of said projecting edge of said track.

Another objective of the present invention is to provide an improved identification locket having a housing with at least one identification element for placement thereon and for identifying a person, pet, or object.

It is still another objective of the present invention to provide an improved identification locket that is low cost and easy to manufacture, advantageous for use on humans, animals, or on devices and configured to address the aforementioned concerns with the prior art.

Additional advantages and features of the present invention will become more apparent when considered in light of the following specification and drawings.

BRIEF DESCRIPTION OF THE SEVERAL VIEWS OF THE DRAWINGS

FIG. 15, FIG. 16, FIG. 17, FIG. 18, and FIG. 19 are still additional embodiments of the identification tag showing the guide piece, recessed elements, and bails.

DETAILED DESCRIPTION OF THE INVENTION

The present invention relates generally to identification tags 10 and similar devices that are attachable to a chain and being used for the identification of a person, pet, animal, or various types of objects. The identification tag 10 of the present invention can be used for personal adornment as a jewelry piece attached to the body or clothes or as identification plates, badges, tags, and similar devices that are attachable to a device.

Figure 1:
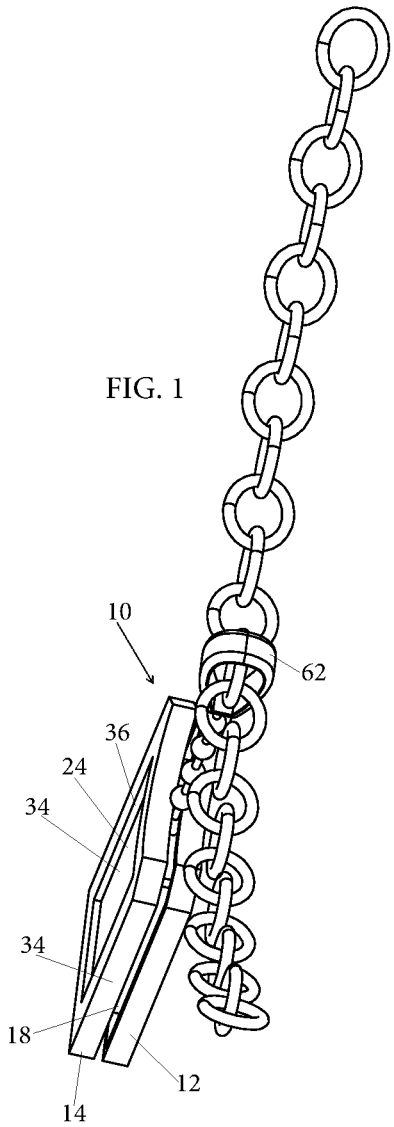
FIG. 1 and FIG. 2 are perspective views of identification tags according to the invention as described herein.
Figure 2:
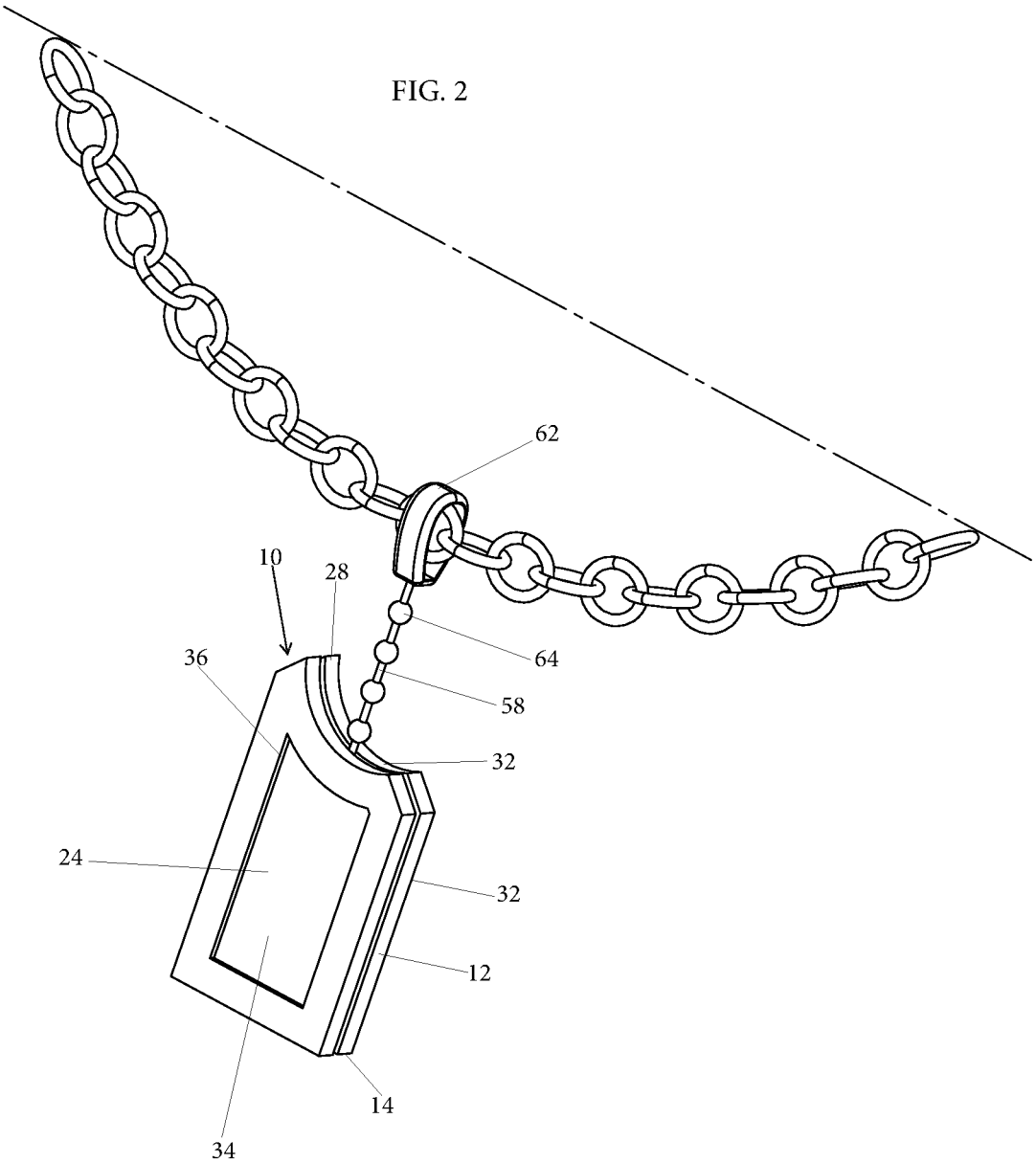
Figure 3:
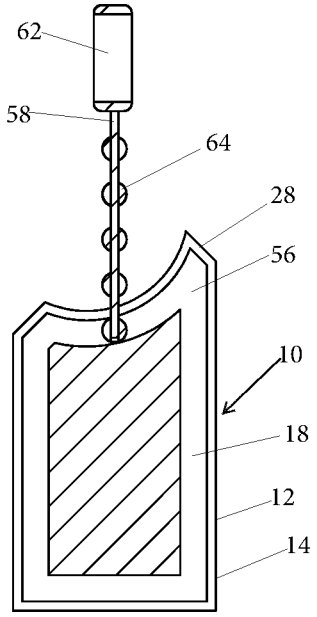
FIG. 3 and FIG. 4 are sectional cutaway views of the identification tags shown in full lines and showing the guide ball moving through the projecting edges of the tracks and the side walls.
Figure 4:
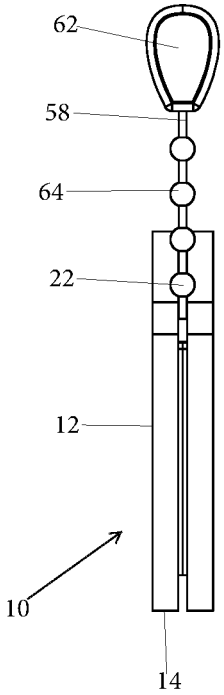
Figure 5:
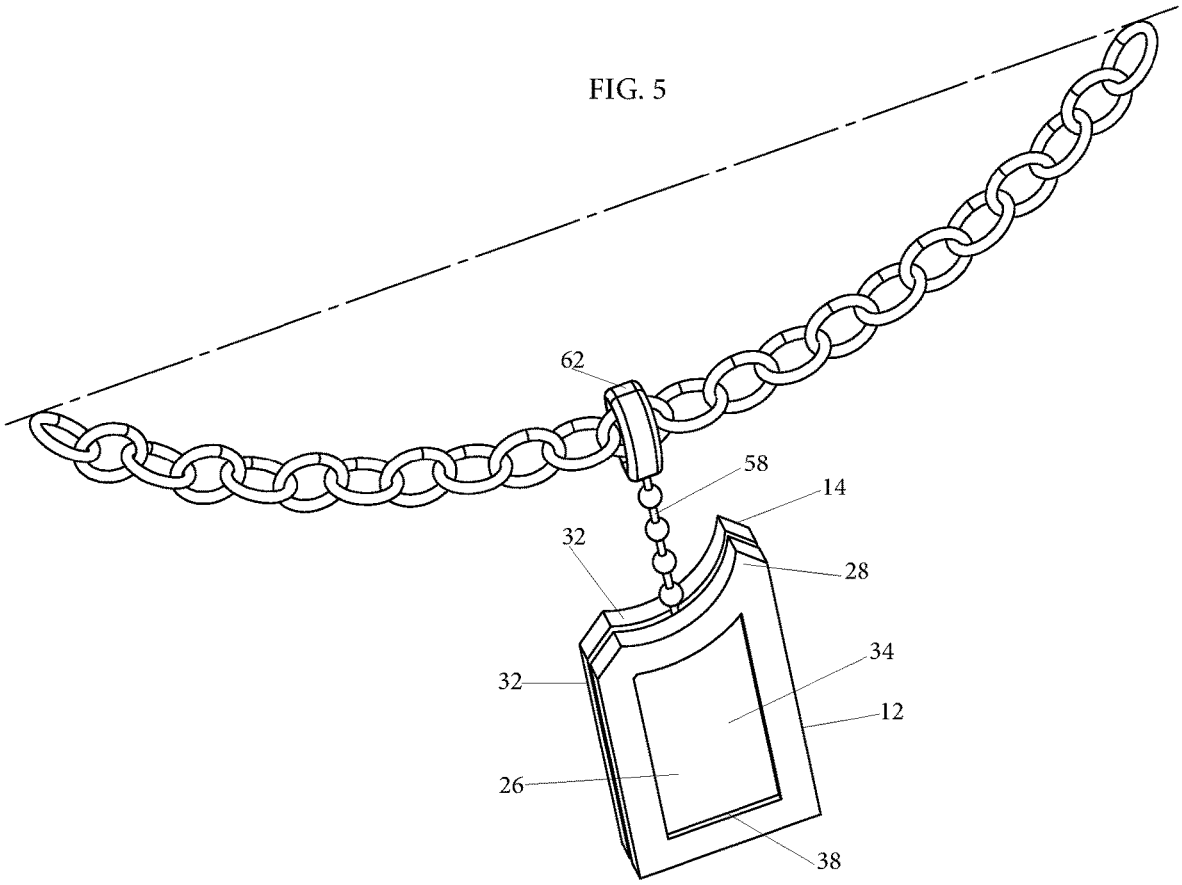
FIG. 5 is a back view of the identification tag according to the invention as described herein.
Figure 6:
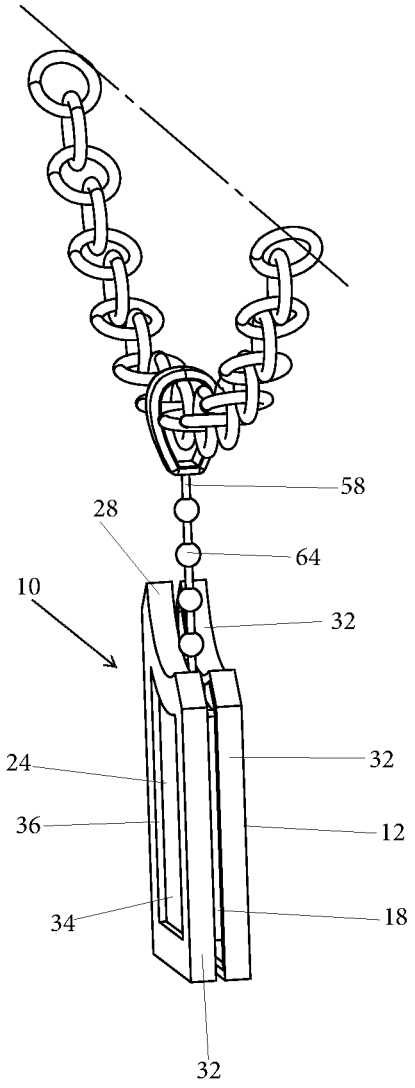
FIG. 6 is a left side view of the identification tag according to the invention as described herein.
Figure 7:
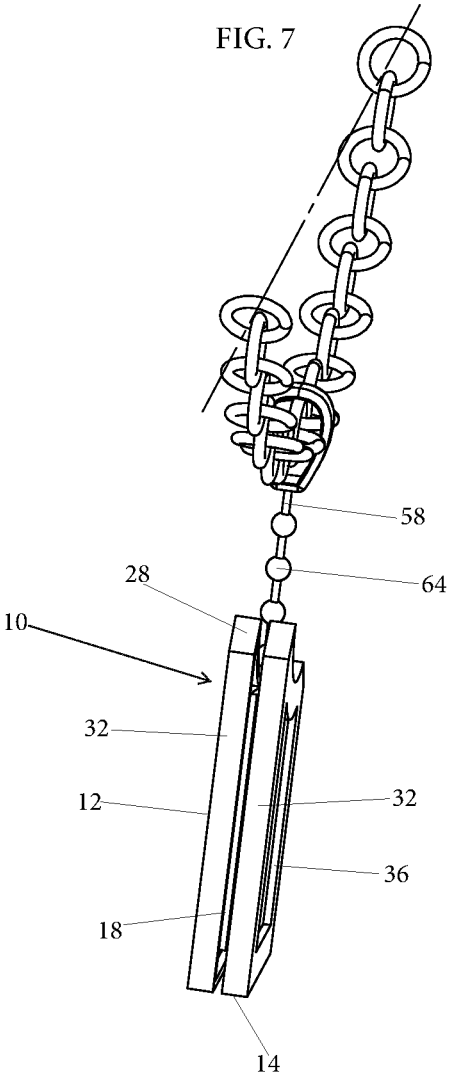
FIG. 7 is a right side view of the identification tag according to the invention as described herein.
Figure 8:
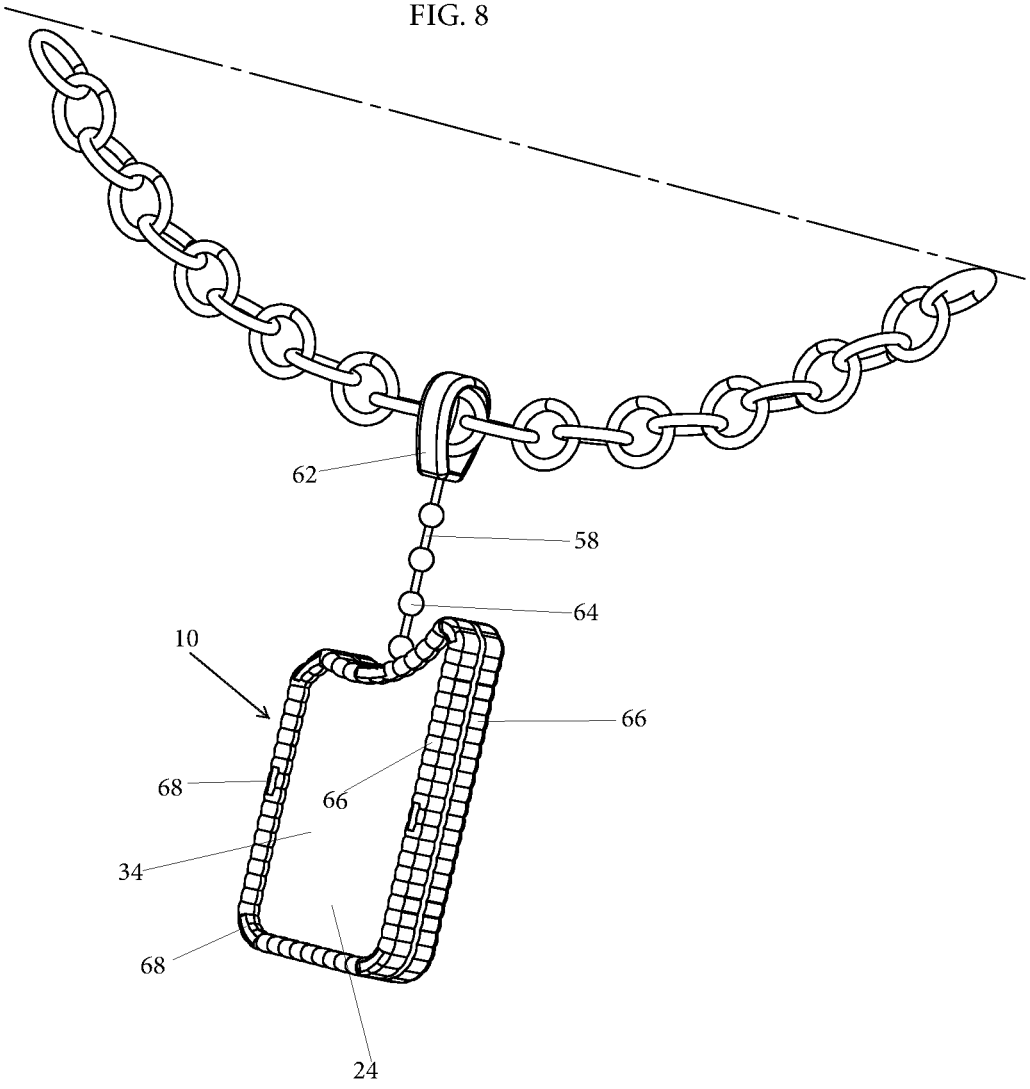
FIG. 8, FIG. 9, and FIG. 10 are additional embodiments of the identification tag showing a plurality of identification elements being placed thereon.
Figure 9:
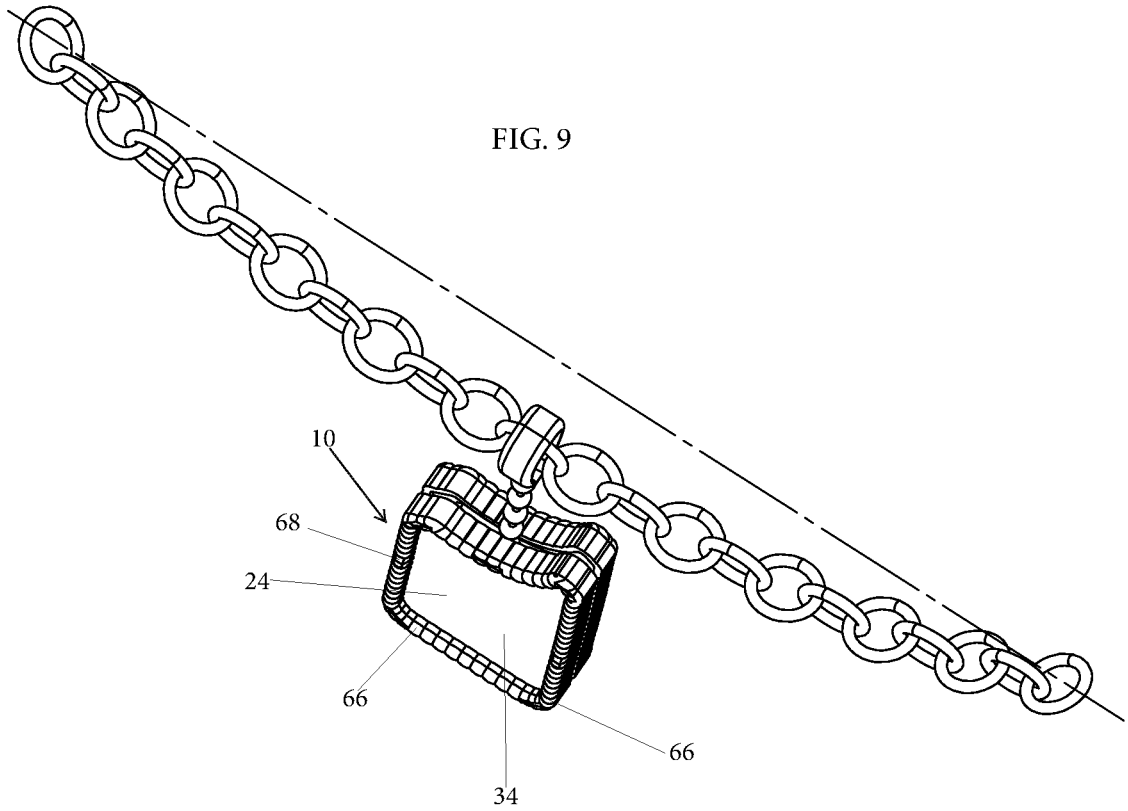
Figure 10:
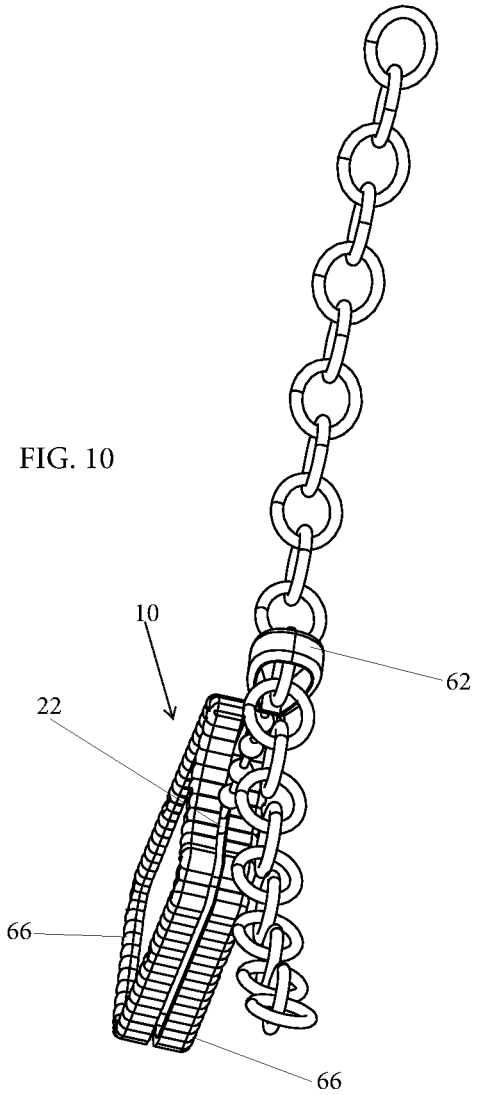
Figure 11:
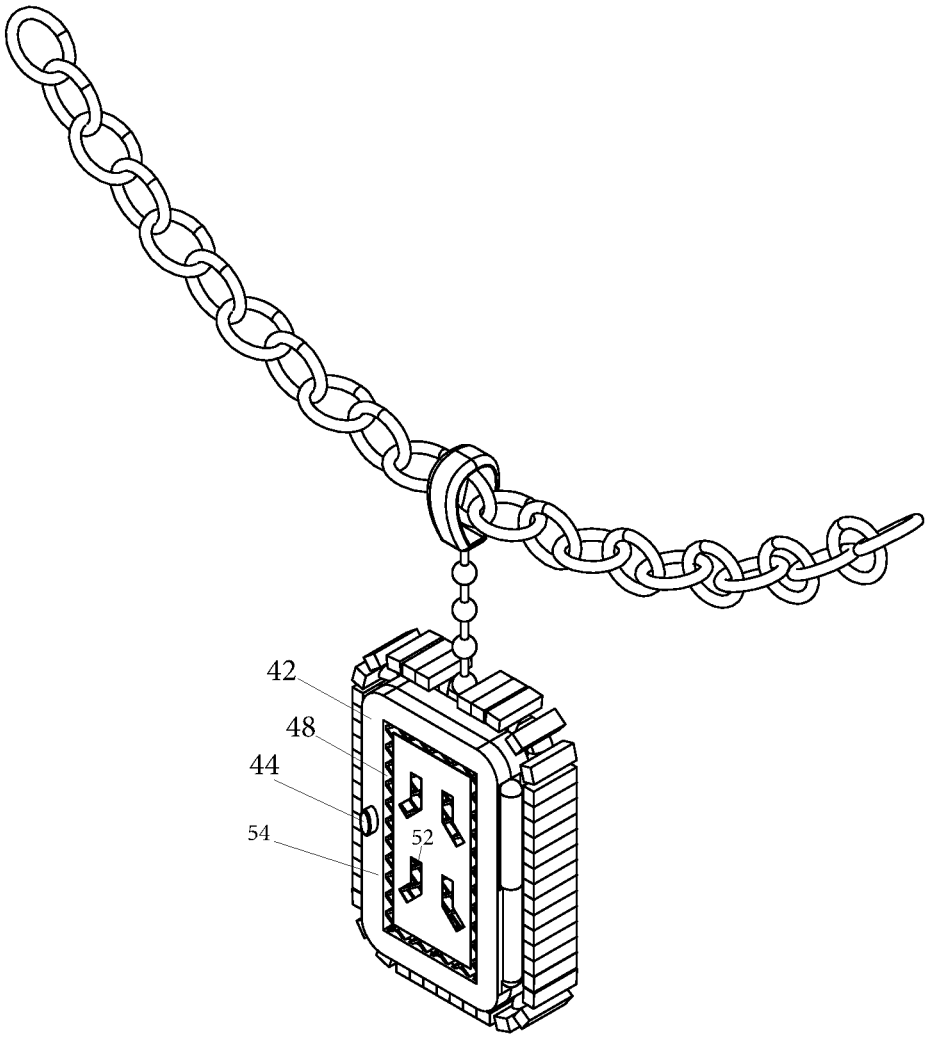
FIG. 11 and FIG. 12 are additional embodiments of the identification tag showing a plurality of identification elements being in the tracks.
Figure 12:
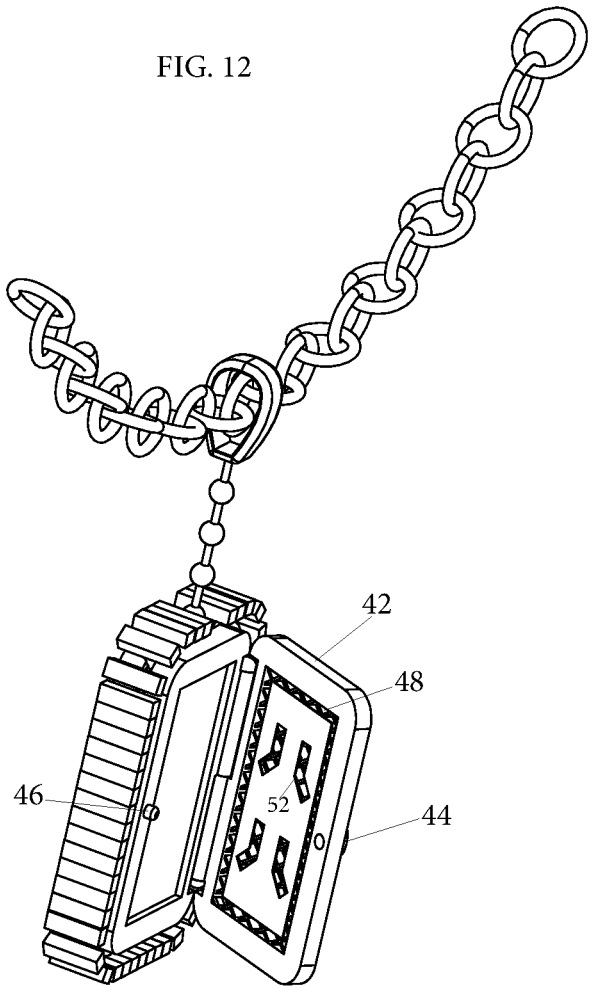
Figure 13:
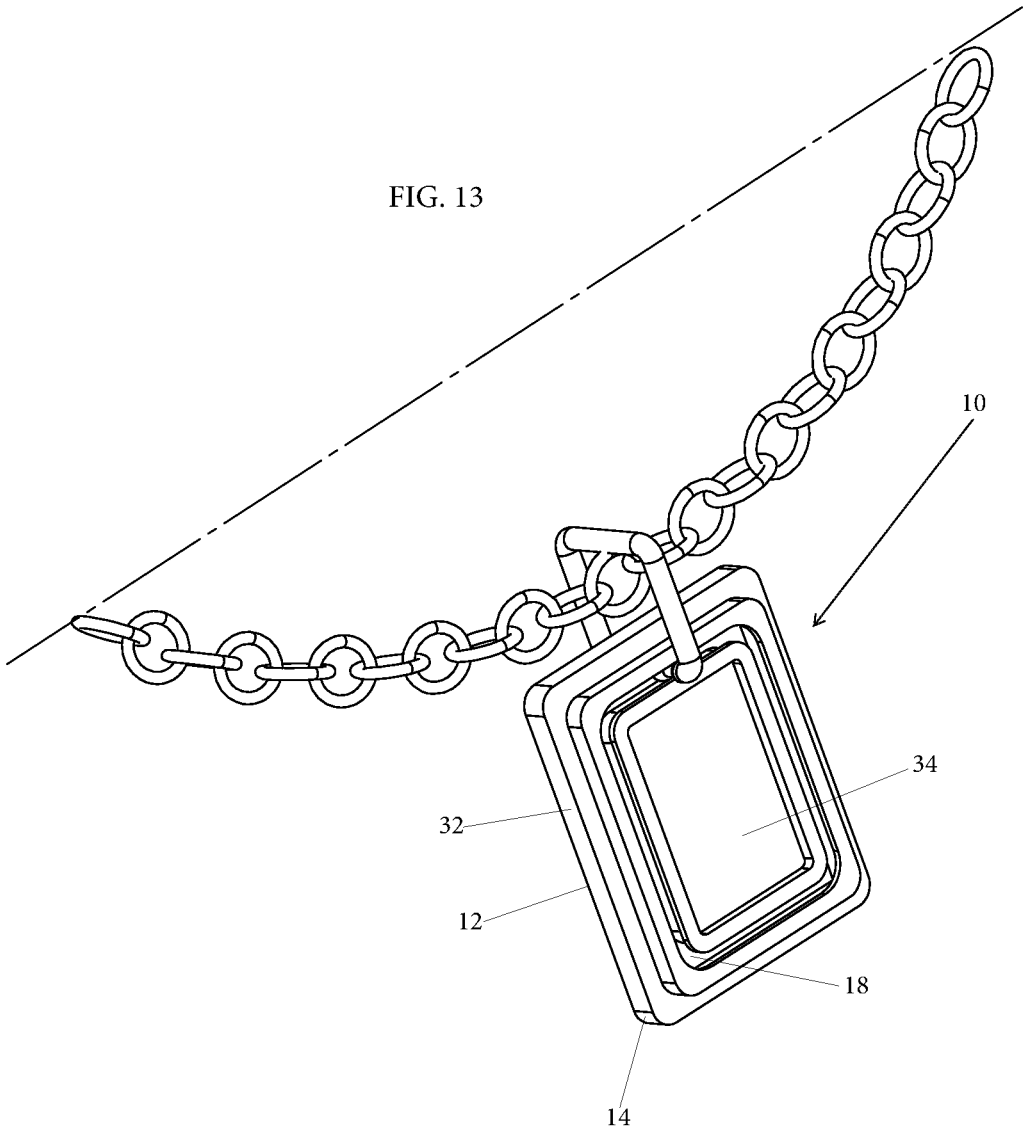
FIG. 13, FIG. 14, and FIG. 15 are additional embodiments of the identification tag showing the tracks being placed in the side walls of the identification tag as described herein.
Figure 14:
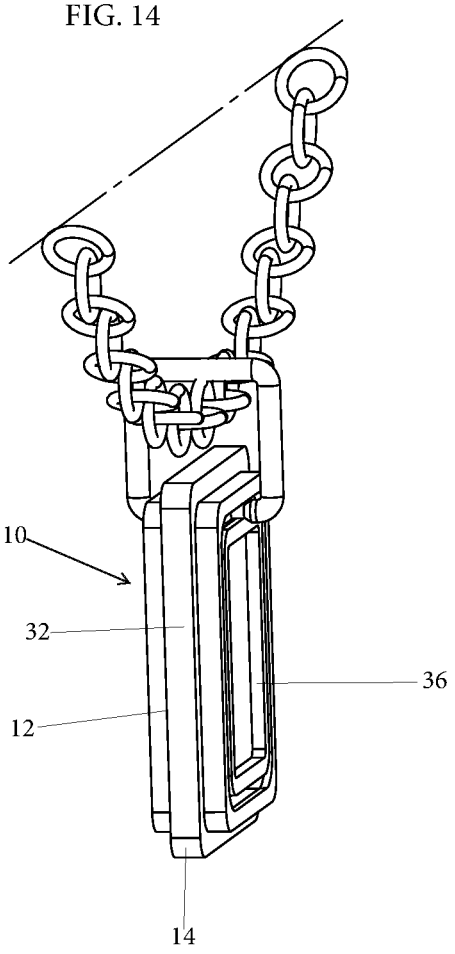
Figure 15:
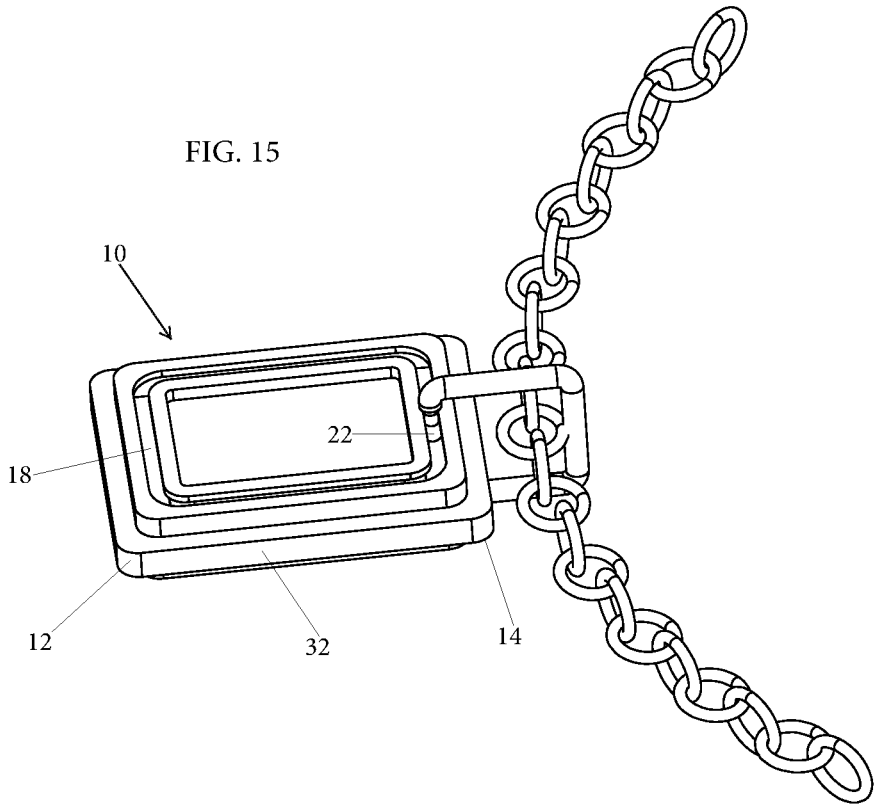
Figure 16:
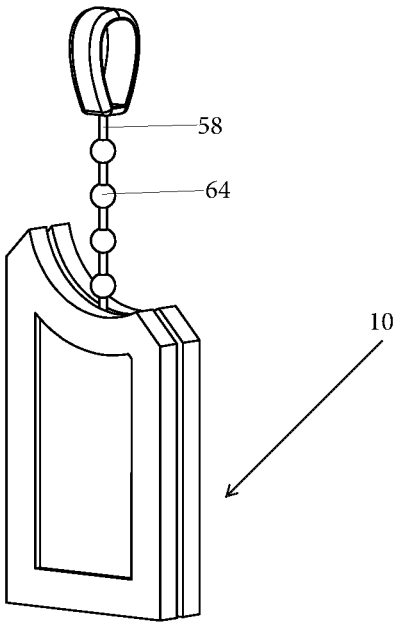
Figure 17:
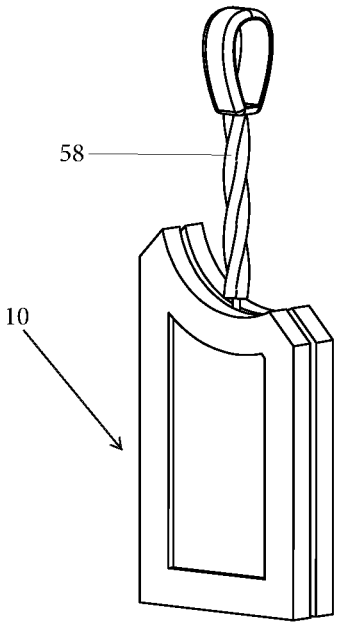
Figure 18:
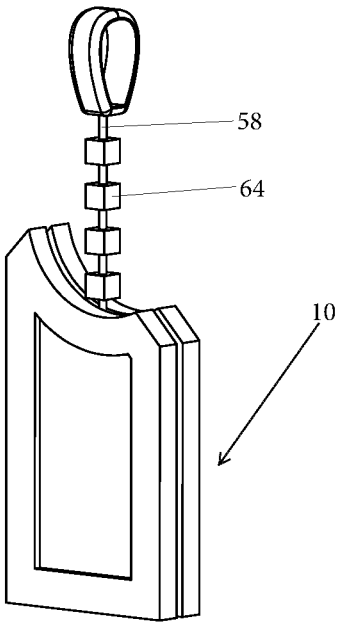
Figure 19:
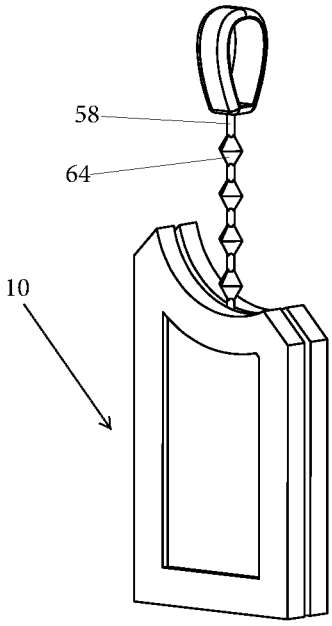

Referring now to the drawings, the attached FIGS. 1-18 show the preferred embodiment of an identification tag 10 having a novel case construction 12. The identification tag 10 comprises a case 12 having an exterior housing 14 with an interior space 16, tracks 18, at least one guide ball 22, a front side 24, a back side 26, and a plurality of side walls 32. The housing can be constructed from a durable material. It is designed to receive a variety of elements of various sizes and formats. The housing has a hollow construction and can be constructed in any size or dimension as desired by a manufacturing company or as needed by a specific group of users. For example, for optimal use, a pet owner might require a miniature identification tag 10 with minimal identification elements 66 being placed thereon.

The identification tag 10 in its entirety can be constructed from a broad range of materials including carbon fiber, precious metals, metals that are commonly used to produce jewelry, durable metals, coral, stones, or other materials such as shells. The precious metals can include silver and copper mixtures, nickel, gold or gold alloys, titanium, platinum, zinc, steel, costume metals, hypoallergenic metals, and stainless steel.

The front side 24 and the back side 26 of the exterior housing have recessed surfaces 34 provided with angled side walls 36 with the recessed surface 34 of the front side 24 having a door 42 being hingedly connected thereon. A fingerplate 44 and an accompanying lock 46 on the interior space 16 of the housing would allow a user to open the case 12 for further use such as storage of personal identification information. The door 42 is shown in an operative position and it can be seen that it comprises a singular panel that is hinged and connected to the interior space 16 of the housing. The housing and side walls 32 are in a connected relationship and hold the door 42 in place. The fingerplate 44 on the front section of the door 42 is operatively arranged to magnetically interact with a second lock 46 member that is located within the housing. This locking 46 member can be made of permanent magnet material.

A plurality of screen slots 48 is placed as a rectangular framework on the front side 24 and abuts the outer edge 54 of the recessed surface 34. A plurality of boot shaped openings 52 can adorn the front side 24 of the case 12 and provide for the subsequent viewing of any personal information that is stored therein. The screen slots 48 can constitute rigid lattice-like structures that are adapted for placement on the front side 24 of the housing. These structures appearing to disappear in each other and the distance between them can be altered when each identification tag 10 is manufactured. The screen slots 48 are see through but would prevent the removal of any inserted items without opening or removing the door 42. The door 42 may also be constructed to include additional ornamental features including precious metals, artwork, drawings, or other forms of personalized decorations. The identification tag 10 can also be constructed with flat or planar surfaces on the front side 24 and the back side 26. The user can therefore use these parallel surfaces as needed to further personalize the identification tag 10 and for placement of additional elements thereon.

The tracks 18 form c-shaped channels on the side walls 32 and have at least one projecting edge 56. The tracks 18 are adapted to house at least one guide ball 22 and the guide ball 22 is further characterized by a guide rope 58 for placement thereon and for further attachment to a standard bail 62 of generally semi-circular shape with pivot points on two opposed sides. If the identification tag 10 is to be removed, held for inspection, held to remove the contents of the locket, or held to adjust the housing, the guide ball 22 will automatically remain in the tracks 18 and thus the ball 22 can be held firmly in position or can be rotated as needed. The guide rope 58 can be braided or unbraided from a plurality of textile including cotton, yarn varieties, paper guide rope, waxed threads, durable plastic material, linen, elastic, nylon, polyester, fibers, long stringy fibrous material, or hemp mixtures. The guide rope 58 can be pre-twisted to keep a specific form or to retain tension.

The bail 62 is particularly useful if the identification tag 10 is worn as a locket, suspended from the neck area of a pet, or used as a keychain. The bail 62 can be removably attached to a necklace, wraparound belt, collar, or chain and guarantees positive identification as needed. The identification tag 10 may also be quickly attached to travel gear, bags, or similar objects. One hand can grip the identification tag 10 and the user can quickly rotate the housing in a circular, backward, or forward direction while the other arm remains on the person. Various forms of identification, e.g., a name, business cards, legal documents, charms, symbols, occupational items, can be placed directly into the interior space 16 or attached to the identification tag 10 as desired.

The guide ball 22 rotates feely and is configured to rotate within the tracks 18 with circular movements, backward, or forward movements. The tracks 18 are configured to rotate a plurality of the guide balls 22 relative to each other wherein the guide rope 58 may freely rotate on the outside of the tracks 18.

The side walls 32 encase the track 18 and comprise at least one projecting edge 28 on at least one of the plurality of side walls 32. The projecting edge 28 of the side wall 32 is attached to the projecting edge 56 of the track 18 and both elements being concave and being provided with a substantially arched downward slope that extend upwardly at a 45 degree angle toward the corresponding side wall 32. The guide ball 22 remains stable within the opposite side of the projecting edge 56 of the track 18.

The guide rope 58 permits horizontal movement of the guide ball 22 upon manual actuation of the guide rope 58 to move the guide balls 22 in the tracks 18. The guide rope 58 is attached to a plurality of recessed elements 64 for decorative placement thereon.

The housing has at least one identification element 66 for placement thereon and for personalization of the identification tag 10. The identification elements 66 can be constructed from various types of materials that have been historically used for decorating or producing jewelry and can be placed around the entire perimeter of the identification tag 10 in a personalized format.

The housing has at least one track identification element 68 for placement in the tracks 18 and for personalization of the identification tag 10. The track identification elements 68 can be constructed from various types of materials that have been historically used for decorating jewelry and can be placed around the entire perimeter of the identification tag 10 in a personalized format. The track identification element 68 being attached to said guide ball 22. The guide ball 22, decorative identification element 66, and track identification element 68 are formed as integral parts of the identification tag 10. These identification elements 66 can be randomly placed to provide a unique source of identification for a user. For example, the arrangement can be unique for a specific institution, store, organized sports team, or memorized by a mobile application or security system. In some cases, it may be used to validate the identity of a person to effectuate a sale, purchase, or deposit.

Variations of the identification tag 10 include but are not limited to the tracks 18 being placed on the front 24 and back 26 sides of the housing. This would require that the guide balls 22 be connected to durable guiding mechanisms that allow for the steady and quick movement of the ball 22 around the tracks 18.

The foregoing description and drawings are an explanation and illustration of the invention and the invention is not limited thereto. Those skilled in the art that have access to the disclosure herein will attempt to make modifications and variations without departing from the scope of the invention. Although the invention has been explained in relation to its preferred embodiment, it is to be understood that many other possible modifications and variations can be made without departing from the spirit and scope of the invention.

What is claimed is:

1. An identification tag having a novel case construction, said identification tag comprising:

a. a case having an exterior housing having an interior space, tracks, at least one guide ball, a front side, a back side, and a plurality of side walls, said front side and said back side having recessed surfaces with an outer edge and provided with angled side walls; said recessed surface of said front side having a door being hingedly connected thereon and said door having a front side, fingerplate, lock, and a plurality of screen slots being placed as a rectangular framework and a plurality of boot shaped openings on said front side of said door, said screen slots abutting the outer edge of said recessed surfaces of said front side;

b. said tracks extending the entire periphery of said side walls and being entirely embedded therein; said tracks forming c-shaped channels on said side walls and having at least one projecting edge, said tracks being adapted to house said guide ball, said guide ball being further characterized by a guide rope for placement on said guide ball and for further attachment to a standard bail of generally semi-circular shape with pivot points on two opposed sides; said guide ball freely rotatable and being configured to rotate within said tracks with circular movements; said guide ball configured to rotate within said tracks with backward or forward movements; said tracks being configured to rotate a plurality of said guide balls relative to each other wherein said guide rope may freely rotate on the outside of said tracks;

c. said plurality of side walls encasing said track and comprising at least one projecting edge on at least one of said plurality of side walls, said projecting edge having an opposite side and being attached to said projecting edge of said track; said projecting edges on said tracks and said top side wall being concave and being provided with a substantially arched downward slope and extending upwardly at a 45 degree angle and extending along said projecting edge; said guide ball remaining within the opposite side of said projecting edge of said track;

d. said guide rope permitting horizontal movement of said guide ball upon manual actuation of said guide rope to move said guide balls in said track; said guide rope being attached to a plurality of recessed elements for decorative placement thereon;

e. said housing having at least one identification element for placement thereon and for personalization of said identification tag, said identification elements can be placed around the entire perimeter of said identification tag in a personalized format;

f. said housing having at least one track identification element for placement in said tracks and for personalization of said identification tag, said track identification elements can be constructed from various types of materials that have been historically used for decorating jewelry and can be placed around the entire perimeter of said identification tag in a personalized format, said track identification element being attached to said guide ball.

2. The identification tag of claim 1, wherein said identification element is formed as an integral part of the article.

3. The identification tag of claim 1, wherein said track identification element is formed as an integral part of said identification tag.

4. The identification tag of claim 1, wherein the identification element is constructed from one of the precious metals, stainless steel, gold or gold alloys.

* * * * *